US009896249B2

(12) United States Patent
Decottignies et al.

(10) Patent No.: US 9,896,249 B2
(45) Date of Patent: Feb. 20, 2018

(54) FLUID-PRODUCT DISPENSER

(71) Applicant: APTAR FRANCE SAS, Le Neubourg (FR)

(72) Inventors: Laurent Decottignies, Cergy (FR); Patrick Muller, Saint Aubin sur Gaillon (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 15/304,240

(22) PCT Filed: Apr. 14, 2015

(86) PCT No.: PCT/FR2015/050991

§ 371 (c)(1),
(2) Date: Oct. 14, 2016

(87) PCT Pub. No.: WO2015/159010

PCT Pub. Date: Oct. 22, 2015

(65) Prior Publication Data

US 2017/0043917 A1 Feb. 16, 2017

(30) Foreign Application Priority Data

Apr. 16, 2014 (FR) ..... 14 53403

(51) Int. Cl.
*B65D 47/24* (2006.01)
*B65D 83/00* (2006.01)

(52) U.S. Cl.
CPC ..... *B65D 47/249* (2013.01); *B65D 83/0038* (2013.01)

(58) Field of Classification Search
CPC ..... B65D 47/249; B65D 83/0038
USPC ..... 222/386, 326
See application file for complete search history.

(56) References Cited

U.S. PATENT DOCUMENTS

| | | | | |
|---|---|---|---|---|
| 3,964,631 | A | 6/1976 | Albert | |
| 6,352,166 | B1 | 3/2002 | Copeland | |
| 2008/0210711 | A1* | 9/2008 | Riesle | B65D 83/0038 222/153.13 |
| 2016/0031631 | A1* | 2/2016 | Kim | B65D 83/0038 221/31 |

OTHER PUBLICATIONS

Translation of International Preliminary Report on Patentability from the International Bureau in counterpart International Application No. PCT/ FR2015/050991.
International Search Report of PCT/FR2015/050991 dated Aug. 5, 2015.

* cited by examiner

*Primary Examiner* — Donnell Long
(74) *Attorney, Agent, or Firm* — Sughrue Mion, PLLC

(57) ABSTRACT

A fluid dispenser comprising a fluid reservoir (R) in which the fluid is stored under pressure, and a fluid outlet valve (6) that is actuatable from a closed position to an open position so as to define a dispenser orifice (53) in a dispenser wall (51), the outlet valve (6) including a movable member (62) that bears in sealed manner against the seat (52) in the closed position and that is not in contact with the seat (52) in the open position, the outlet valve (6) including an actuator member (65) for moving the movable member (62) between the closed and open positions, the fluid dispenser being characterized in that the movable member (62) and the actuator member (65) should both be arranged on a pivot lever (61).

11 Claims, 2 Drawing Sheets

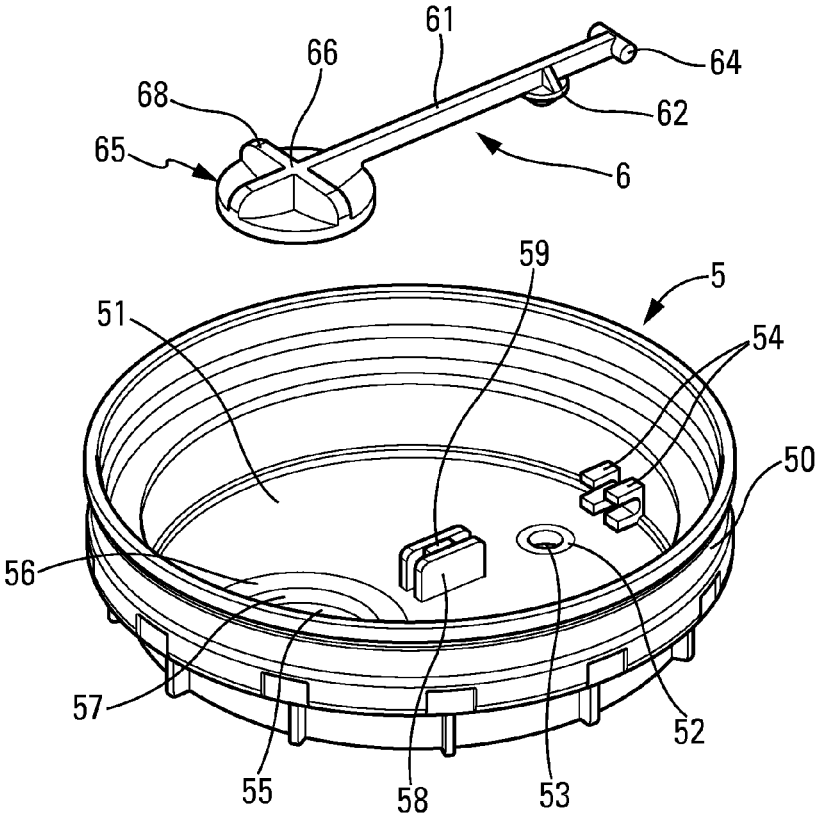
Fig. 4
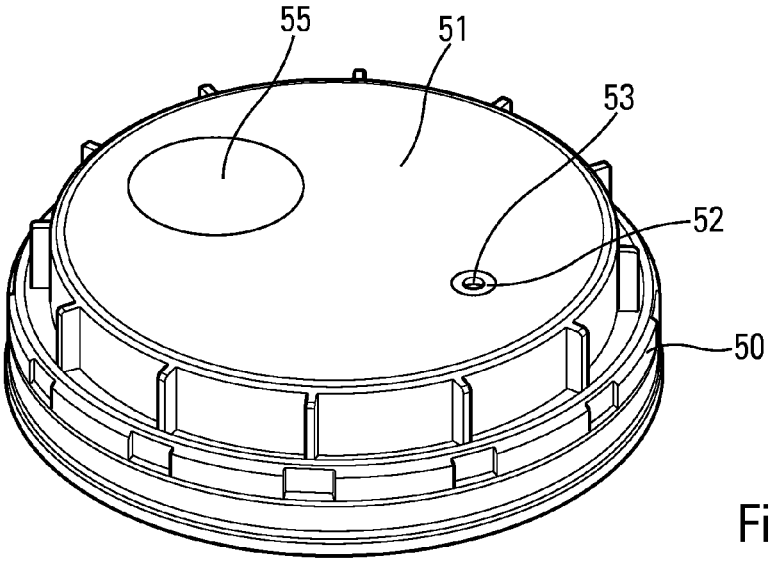
Fig. 5
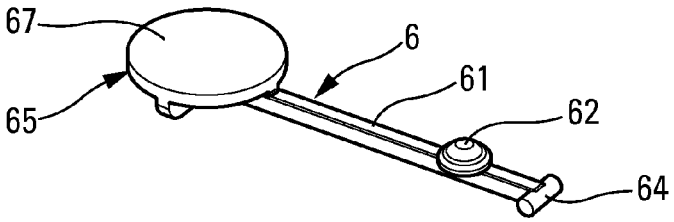

FLUID-PRODUCT DISPENSER

CROSS REFERENCE TO RELATED APPLICATIONS

This application is a National Stage of International Application No. PCT/FR2015/050991 filed Apr. 14, 2015, claiming priority based on French Patent Application No. 1453403, filed Apr. 16, 2014, the contents of which are incorporated herein by reference in their entirety.

The present invention relates to a fluid dispenser comprising a fluid reservoir in which the fluid is stored under pressure, and a fluid outlet valve that is actuatable from a closed position to an open position so as to define a dispenser orifice in a dispenser wall. The outlet valve includes a movable member that bears in sealed manner against a seat in the closed position and that is not in contact with the seat in the open position. The outlet valve also includes an actuator member for moving the movable member between the closed and open positions. This type of dispenser is widely used in the fields of cosmetics, perfumery, pharmacy, and food, so as to dispense fluids that are viscous to a greater or lesser extent.

In the prior art, numerous dispensers are already known that are fitted with an actuator member that is pressed so as to open an outlet valve allowing a fluid stored under pressure in a reservoir to be dispensed. In particular, aerosols exist that contain a propellant gas. In general, they are fitted with a dispenser valve that is fitted with a valve rod that is pressed axially or laterally. Dispensers are also known having a reservoir that is fitted with a pusher piston that is biased by a spring, for example. That type of dispenser is also fitted with an outlet valve or with a dispenser valve. In entirely general manner, most outlet valves or valve members are fitted with a return spring, and actuation of the actuator member requires the stiffness of the return spring to be overcome.

The present invention wishes to break radically with traditional techniques in order to propose an outlet valve for which the force necessary to move the actuator member is smaller, while guaranteeing complete sealing. The present invention also wishes to break with the usual hand movement that consists in axially depressing or laterally tilting a valve rod. The present invention also seeks to depart from any unitary dosage, so as to offer dispensing for as long as the actuator member is actuated. Finally, the present invention seeks to improve significantly the dispensing of creams that are packaged in pots.

To do this the present invention proposes that the movable member and the actuator member should both be arranged on a pivot lever. Thus, the lever length that separates the movable member from the actuator member serves to increase the force, such that it is not necessary to press hard on the actuator member in order to open the outlet orifice. With this design, it is no longer necessary to overcome the stiffness of any return spring.

Advantageously, the pivot lever includes a pin that is situated at a stationary end of the lever, the lever also including a movable end that is remote from the stationary end, the movable member being situated closer to the stationary end than to the movable end, and the actuator member being situated closer to the movable end than to the stationary end. Naturally, the closer the movable member is to the stationary end, and the closer the actuator member is to the movable end, the greater the force-increasing effect.

According to another advantageous characteristic, the dispenser wall is substantially plane, the actuator member being actuatable from the dispenser wall. More particularly, this design is adapted to a pot that is closed by a lid that forms the plane dispenser wall. In this configuration, the lever advantageously extends parallel to and under the dispenser wall.

In another advantageous aspect of the invention, the actuator member includes two opposite faces, namely an inside face that is subjected to the fluid under pressure, and an outside face that is free of any pressure exerted by the fluid, such that the pressure exerted by the fluid on the inside face of the actuator member is transmitted via the lever to the movable member that is thus pushed against the seat in sealed manner. Thus, the actuator member participates in returning the movable member rapidly into its seat. As a result, there is no need to provide a return spring: the mere pressure of the fluid stored in the reservoir sufficing to return the outlet valve into its the closed position.

In a practical embodiment, the dispenser includes a pusher on which the user may press so as to dispense the fluid through the dispenser orifice, the outside face of the actuator member being intimately coupled to the pusher, so that the fluid under pressure cannot pass between them. It is thus guaranteed that the outside face is not subjected to the pressure exerted by the fluid. Advantageously, the pusher is made out of an elastically-deformable material, the outside face of the actuator member being sealed, advantageously adhesively-bonded, to the pusher. In a variant, it is possible to make the pusher with an elastic-deformation characteristic, without the outside face of the actuator member being intimately connected thereto. In this configuration, the resilient return force that makes it possible to return the outlet valve into its closed position is mainly provided by the elastic characteristic of the pusher.

In an embodiment that is particularly adapted to a pot, the pusher and the dispenser orifice are formed by the dispenser wall. Thus, the dispenser wall of the lid includes two elements that are clearly visible and that are spaced apart from each other, namely firstly the pusher and secondly the dispenser orifice that may be arranged in diametrically-opposite manner.

In a practical aspect, the dispenser wall may include guide elements for guiding the lever while it is pivoting. The guide elements may also limit the degree to which the lever pivots.

As already mentioned, the dispenser of the invention is particularly suitable when it forms a pot and a lid that is mounted on the pot, the lid forming the dispenser wall with its dispenser orifice and its pusher.

In another technical aspect, the reservoir includes a pusher piston that slides in leaktight manner in a slide cylinder, the pusher piston being biased by resilient means selected from springs, foams, and gases. More generally, any technical arrangement making it possible to put the contents of a reservoir under pressure may be used in the context of the present invention.

The spirit of the invention resides in the element that closes the dispenser orifice and the element that makes it possible to release the dispenser orifice being arranged on a single pivot lever with a certain distance between them so as to create a force-increasing effect that makes it possible to decrease the force necessary to actuate the dispenser. This results in actuation that is gentle, which is in total contrast to the degree of sealing at the dispenser orifice in the closed position. When the dispenser wall is plane, it is advantageous for the lever to extend parallel to and immediately under the wall.

The invention is described below more fully with reference to the accompanying drawings, which show an embodiment of the invention by way of non-limiting example.

In the figures:

FIGS. 4 and 5 are exploded perspective views of a portion of the dispenser in FIGS. 1 to 3.

Figure 1:
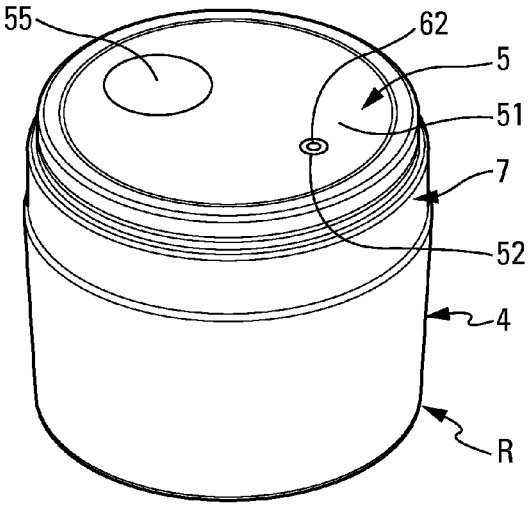
FIG. 1 is a substantially life-size perspective view of a fluid dispenser of the invention.
Figure 3:
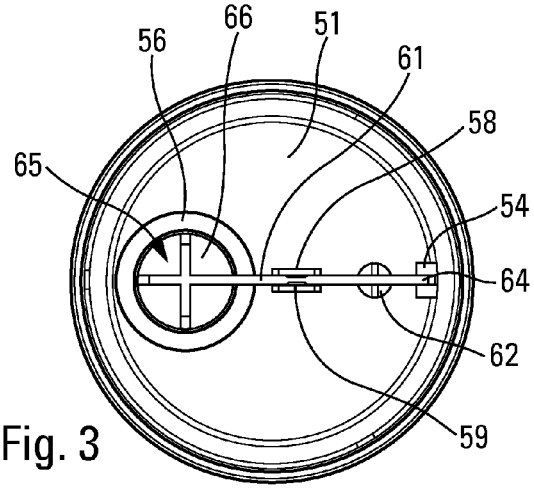
FIG. 3 is a plan view of the inside of the FIG. 1 dispenser.

Since it is a pot, the dispenser shown in the figures in order to illustrate the present invention is of a particular type that is characterized by its short and stocky shape. It can also be said that the pot is characterized by a top face that is substantially plane with a diameter that corresponds substantially to the diameter of the reservoir.

In the embodiment shown, the fluid reservoir R is associated with a lid 5 that is mounted on a neck 41 in stationary and leaktight manner, e.g. by interposing a neck gasket 8. In this embodiment, the reservoir R presents a configuration that is somewhat particular, since it comprises an inner container 1 that is arranged inside an outer pot 4. The inner container 1 internally includes a slide cylinder 11 and a bottom wall 12. The container 1 also contains a pusher piston 2, e.g. provided with two sealing lips 21. In this embodiment, the pusher piston 2 is biased by resilient means that are in the form of a spring 3 that may be a coil spring, and that bear firstly against the bottom wall 12 and secondly beneath the pusher piston 2. It can easily be understood that the force of the spring 3 pushes the pusher piston 2 in such a manner as to exert pressure on the fluid that is present above the follower piston 2. By way of example, the inner container 1 may form a collar against which the neck gasket 8 bears and under which the neck 41 is formed that comes into engagement with the lid 5 so as to close the reservoir R.

Without going beyond the ambit of the invention, another type of reservoir could naturally be used, e.g. that does not include an outer pot 4. However, the outer pot makes it easy to give the reservoir a conventional pot shape, independently of the capacity and the shape of the inner container 1.

The lid 5 includes an annular fastener ring 50 that becomes securely engaged with the neck 41 so as to flatten the neck gasket 8. Thus, the lid 5 and the reservoir R and fastened together in stable and leaktight manner. The lid 5 also includes a dispenser wall 51 that is advantageously formed in substantially plane manner. This also participates in giving the dispenser a pot configuration. The dispenser wall 51 serves as a fluid recovery surface from which the user recovers the fluid that has been dispensed.

Initially, the dispenser wall 51 is perforated with a dispenser orifice 53 having an edge that forms a valve seat 52. Advantageously, it is possible to make the valve seat 52 out of a material that is different from the remainder of the lid 51, in particular a material that is more flexible, e.g. using an over-molding or bi-injection method. This gives the valve seat 52 greater sealing qualities. Advantageously, the valve seat 52 presents a shape that is frustoconical, having a vertex that constitutes the dispenser orifice 53.

Figure 2:
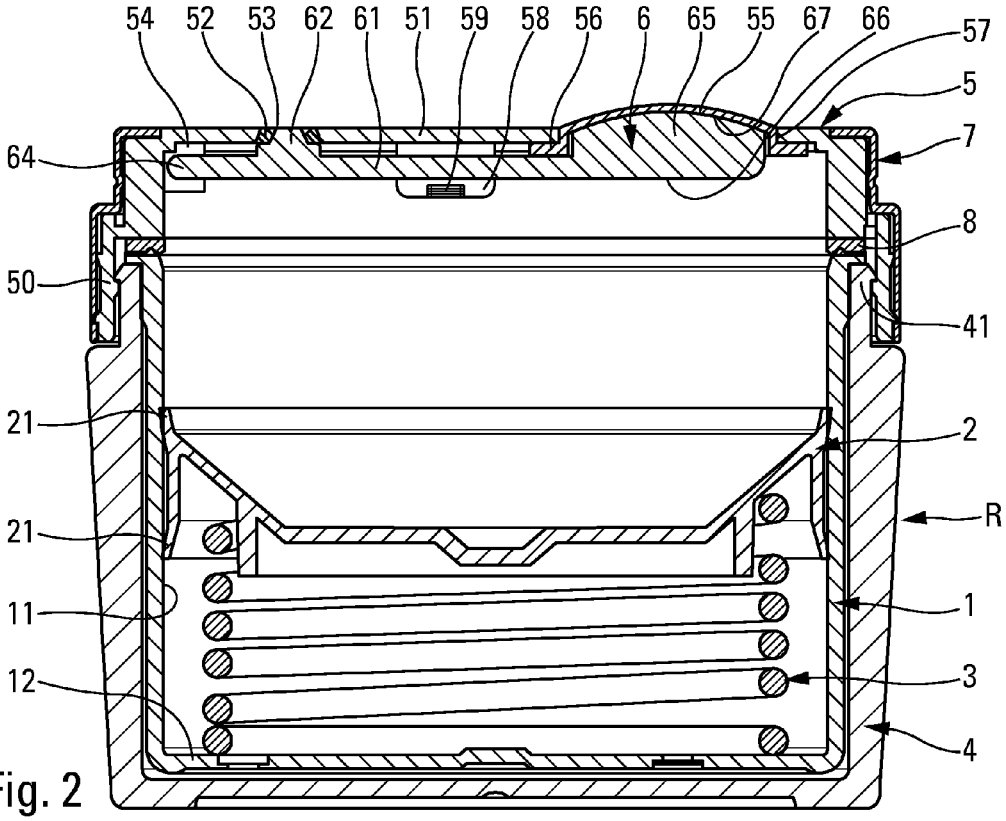
FIG. 2 is a larger-scale vertical section view through the FIG. 1 dispenser.

The dispenser wall 51 is also provided with a pusher 55 on which the user may press vertically so as to move it over a certain stroke. Advantageously, the pusher is made from a flexible material that may be identical to the material of the valve seat 52. The pusher 55 may form an annular skirt 57 and an anchor ring 56 that extends under the dispenser wall 51, as can be seen in FIG. 2. When the pusher 55 is pressed, it is essentially the skirt 57 that is subjected to deformation stresses. As with the valve seat 52, the pusher 55 may be made using a bi-injection or over-molding technique. It is essential that sealing is achieved between the pusher 55 and the remainder of the dispenser wall 51, so as to avoid any fluid leaking out.

On its inside face, the dispenser wall 51 is further provided with pin-receiving bearings 54, more visible in FIG. 4, that also bear against the fastener ring 50. In addition, the inside face of the dispenser wall 51 may also be provided with guide elements 58 that may be in the form of two parallel tabs that are separated by a certain distance. Advantageously, each tab is provided with a projecting bar 59 that projects from the inside face, such that the bars 59 face each other and locally reduce the gap between the two tabs 58. It should be observed that the pin-receiving bearings 54, the dispenser orifice 53, the pusher 55, and the two optional tabs 58 are arranged in alignment along a diameter of the dispenser wall 51. As can be seen in FIG. 1, on the outside face of the dispenser wall 51, it is possible to see only the valve seat 52 and the pusher 55 that are arranged in substantially diametrically-opposite manner.

In the invention, the dispenser also includes an outlet valve 6 that comprises a lever 61, a movable outlet valve member 62, a pivot pin 64, and an actuator member 65. The pivot pin 64 is formed at an end of the lever 61, which end is held stationary, given that the pivot pin 64 is for engaging in the bearing 54 of the lid 5. The actuator member 65 is formed at a distance at the other end that forms a movable end. The movable outlet valve member 62 is formed on the lever 61, in the proximity of the pivot pin 64. More generally, it can be said that the movable member 62 is closer to the pin 64 than to the more remote other end where the actuator member 65 is formed.

With reference once again to FIG. 2, the outlet valve 6 can be seen in place under the dispenser wall 51. It should immediately be observed that the lever 61 extends under the dispenser wall 51, substantially parallel thereto. The pivot pin 64 is engaged in the bearings 54, the movable member 62 is engaged in the dispenser orifice 53 and comes into sealed contact with the valve seat 52, the lever 61 is engaged between the two tabs 58 and cannot be removed therefrom as a result of the presence of the two bars 59, and the actuator member 65 is engaged with the pusher 55. In FIG. 2, the outlet valve 6 is in its closed or rest position. From this position, the user may press axially downwards on the pusher 55 so as to deform it and move the actuator member 65 towards the inside of the reservoir. As a result of the rigidity of the lever 61, the movable member 62 also moves, but over a shorter distance as a result of the lever or force-increasing effect. Nevertheless, the movable member 62 lifts off the seat 52 such that the dispenser orifice is open. The fluid stored under pressure in the reservoir may thus exit through the dispenser orifice 53 and spread over the dispenser wall 51 while the actuator member 65 is depressed by the pusher 55. Dispensing ends when the user releases pressure on the pusher 55, which then returns into its closed or rest position. The resilient return of the pusher 55 as a result of its shape memory may make it possible for it alone to return the actuator member 65 towards its rest position. To do this, it is necessary for the actuator member 65 to be connected to the pusher 55 in such a manner that they move together. The actuator member 65 and the pusher 55 may be connected by any technical means, e.g. by adhesive-bonding, by heat-sealing, by snap-fastening, etc.

In an advantageous aspect of the invention, the actuator member 65 includes two opposite faces, namely an inside face 66 that faces towards the reservoir and that is subjected to the pressure exerted by the fluid, and an outside face 67 that faces towards the pusher 55. According to a characteristic of the invention, the outside face 67 is intimately connected to the pusher 55, such that the pressure exerted by the fluid is not exerted on the outside face 67. In other words, the intimate contact should prevent any fluid from passing between the actuator member 65 and the pusher 55. Thus, the pressure exerted by the fluid is exerted only on the inside face 66, such that it tends to return the outlet valve into its closed, rest position. It is thus no longer necessary to use the resilient return force associated with the shape memory of the material constituting the pusher 55. The thrust exerted by the fluid on the actuator member 65 increases with increasing area of the inside face 66. This is why the actuator member 65 may, for example, be made in the shape of a disk presenting a diameter that is significant, e.g. of about 1 centimeter (cm). The disk is connected to the lever 61 via a reinforcing cross 68, as can be seen in FIG. 4.

It should be observed that the outlet valve 6 may be made easily by injection-molding a substantially rigid plastics material, e.g. polyethylene or polypropylene. The valve 6 is mounted in the lid 5 in relatively easy manner, since it suffices to insert the pin 64 in the bearings 54, then to guide the lever 61 between the tabs 58. The intimate contact between the outside face 67 of the actuator member 65 and the pusher 55 may be achieved very simply by adhesive-bonding, for example. However, the intimate connection could be achieved by heat-sealing, by snap-fastening, or by force fitting.

As a result of the outlet valve of the invention, it is very easy to space the dispenser orifice 53 apart from the pusher 55 merely by acting on the length of the lever 61. The greater the distance that separates the orifice from the pusher, the smaller the force necessary to depress the pusher 55.

An advantage of the present invention resides in the fact that the pressure of the fluid does not degrade the sealing of the dispenser orifice: on the contrary, it contributes thereto, and in enhanced manner, as a result of the pressure of the fluid being exerted on the actuator member.

The present invention thus provides a dispenser, preferably in the form of a pot that is closed by a lid, that includes an outlet valve that is practically imperceptible and incomprehensible to the user, in particular as a result of the pusher 55 being situated at a distance from the dispenser orifice 53.

The invention claimed is:

1. A fluid dispenser comprising a fluid reservoir (R) in which the fluid is stored under pressure, and a fluid outlet valve (6) that is actuatable from a closed position to an open position so as to define a dispenser orifice (53) in a dispenser wall (51), the dispenser orifice (53) defining an edge that forms a valve seat (52), the dispenser wall (51) serving as a fluid recovery surface at the outlet of the dispenser orifice (53), the outlet valve (6) including a movable member (62) that bears in sealed manner against the seat (52) in the closed position and that is not in contact with the seat (52) in the open position, the outlet valve (6) including an actuator member (65) for moving the movable member (62) between the closed and open positions, the fluid dispenser being characterized in that the movable member (62) and the actuator member (65) are both arranged on a pivot lever (61).

2. The fluid dispenser according to claim 1, wherein the pivot lever (61) includes a pin (64) that is situated at a stationary end of the lever, the lever (61) also including a movable end that is remote from the stationary end, the movable member (62) being situated closer to the stationary end than to the movable end, and the actuator member (65) being situated closer to the movable end than to the stationary end.

3. The fluid dispenser according to claim 1, wherein the dispenser wall (51) is substantially plane, the actuator member (65) being actuatable from the dispenser wall (51).

4. The fluid dispenser according to claim 1, wherein the lever (61) extends parallel to and under the dispenser wall (51).

5. The fluid dispenser according to claim 1, wherein the actuator member (65) includes two opposite faces (66, 67), namely an inside face (66) that is subjected to the pressure exerted by the fluid under pressure, and an outside face (67) that is free of any pressure exerted by the fluid, such that the pressure exerted by the fluid on the inside face (66) of the actuator member (65) is transmitted via the lever (61) to the movable member (62) that is thus pushed against the seat (52) in sealed manner.

6. The fluid dispenser according to claim 5, including a pusher (55) on which the user may press so as to dispense the fluid through the dispenser orifice (53), the outside face (67) of the actuator member (65) being intimately coupled to the pusher (55), so that the fluid under pressure cannot pass between them.

7. The fluid dispenser according to claim 6, wherein the pusher (55) is made out of an elastically-deformable material, the outside face (67) of the actuator member (65) being sealed, advantageously adhesively-bonded, to the pusher (55).

8. The fluid dispenser according to claim 6, wherein the pusher (55) and the dispenser orifice (53) are formed by the dispenser wall (51).

9. The fluid dispenser according to claim 1, wherein the dispenser wall (51) includes guide elements (58, 59) for guiding the lever (61) while it is pivoting.

10. The fluid dispenser according to claim 1, comprising a pot (4) and a lid (5) that is mounted on the pot (4), the lid (5) forming the dispenser wall (51).

11. The fluid dispenser according to claim 1, wherein the reservoir (R) includes a pusher piston (2) that slides in leaktight manner in a slide cylinder (11), the pusher piston (2) being biased by resilient means (3) selected from springs, foams, and gases.

* * * * *